US011602836B1

(12) United States Patent
Hartley, Jr.

(10) Patent No.: US 11,602,836 B1
(45) Date of Patent: Mar. 14, 2023

(54) INTERCHANGEABLE MODULAR WORKBENCH SYSTEM

(71) Applicant: Robert Edgar Hartley, Jr., Newberg, OR (US)

(72) Inventor: Robert Edgar Hartley, Jr., Newberg, OR (US)

( * ) Notice: Subject to any disclaimer, the term of this patent is extended or adjusted under 35 U.S.C. 154(b) by 39 days.

(21) Appl. No.: 17/229,507

(22) Filed: Apr. 13, 2021

Related U.S. Application Data

(60) Provisional application No. 63/008,973, filed on Apr. 13, 2020.

(51) Int. Cl.
*B25H 1/14* (2006.01)
*B25H 1/02* (2006.01)

(52) U.S. Cl.
CPC ..... *B25H 1/14* (2013.01); *B25H 1/02* (2013.01)

(58) Field of Classification Search
CPC . B25H 1/00; B25H 1/005; B25H 1/02; B25H 1/04; B25H 1/08; B25H 1/14; B25B 11/00
USPC ..... 269/309; 108/11, 13, 158.13; 144/286.1, 144/286.5
See application file for complete search history.

(56) References Cited

U.S. PATENT DOCUMENTS 3,088,421 A * 5/1963 Ferris ..... A47B 13/081 108/13
3,635,174 A * 1/1972 Ball ..... A47B 21/06 108/150
4,350,193 A * 9/1982 McCambridge ..... B25H 1/14 144/1.1
4,375,827 A * 3/1983 Ignjatic ..... B25H 1/08 269/253
4,465,114 A * 8/1984 Schumacher ..... B27B 5/201 144/1.1
5,197,393 A * 3/1993 Yeakle ..... A47B 9/10 108/147
7,077,179 B1 * 7/2006 Camiano ..... B23D 45/065 144/1.1
10,377,032 B1 * 8/2019 Kadosh ..... B25H 1/04
(Continued)

FOREIGN PATENT DOCUMENTS

CN 107960743 A * 4/2018
DE 202005001491 U1 * 7/2005
EP 0151410 A2 * 8/1985

OTHER PUBLICATIONS

CN-107960743—A description in English Espacenet (Year: 2022).*
(Continued)

*Primary Examiner* — Joseph J Hail
*Assistant Examiner* — Timothy Brady
(74) *Attorney, Agent, or Firm* — Plager Schack LLP; Mark H. Plager; Kara V. Verryt

(57) ABSTRACT

A modular workbench system for quickly and easily interchanging a portion thereof may include a workbench with a cutout therein and a modular insert panel designed to removably engage with the cutout in the workbench. The edge of the cutout may include bench grooves, such as a bench finger joint, and the modular insert panel may include insert grooves, such as an insert panel finger joint, on an outer edge thereof, wherein the insert grooves are designed to removably engage with the bench grooves. The modular insert panel may include a tool premounted thereto.

10 Claims, 4 Drawing Sheets

(56) References Cited

U.S. PATENT DOCUMENTS

2006/0191446 A1* 8/2006 Discacciati ..... A47B 3/12
108/59

OTHER PUBLICATIONS

DE-202005001491-U1 (Year: 2022).*
EP-0151410-A2 (Year: 2022).*
Merriam-Webster definition & meaning for "Collar" (Year: 2022).*
Mobile Workbench With Built-in Table & Miter Saws (comments from 2016) https://www.instructables.com/Mobile-Workbench-With-Built-in-Table-Miter-Saws/ (Year: 2022).*

* cited by examiner

INTERCHANGEABLE MODULAR WORKBENCH SYSTEM

RELATED APPLICATION

This application claims priority to provisional patent application U.S. Ser. No. 63/008,973 filed on Apr. 13, 2020, the entire contents of which is herein incorporated by reference.

BACKGROUND

The embodiments described herein relate generally to workbenches and, more particularly, to a workbench with an interchangeable, modular insert.

Workbenches, such as workbenches and counters, provide only limited space. Particularly when talking about workbenches, there is the need for multiple mounted electrical and hand powered tools for completing projects and tasks. Conventionally, the mounted tools, such as a grinder, drill press, or vice, can only be mounted to the workbench by drilling multiple holes and sacrificing the integrity and aesthetic look of the bench top. These tools generally end up being permanently mounted, thus always taking up some of the workspace.

Therefore, what is needed is a workbench that provides for the interchanging of modular inserts depending on need, thus preserving the integrity, strength, and aesthetic of the workbench while still allowing for rapid and efficient tool swapping.

SUMMARY

Some embodiments of the present disclosure include a modular workbench system for quickly and easily interchanging a portion thereof. The system may include a workbench with a cutout therein and a modular insert panel designed to removably engage with the cutout in the workbench. The edge of the cutout may include bench grooves, such as a bench finger joint, and the modular insert panel may include insert grooves, such as an insert panel finger joint, on an outer edge thereof, wherein the insert grooves are designed to removably engage with the bench grooves. The modular insert panel may include a tool premounted thereto.

BRIEF DESCRIPTION OF THE FIGURES

The detailed description of some embodiments of the invention is made below with reference to the accompanying figures, wherein like numerals represent corresponding parts of the figures.

DETAILED DESCRIPTION

In the following detailed description of the invention, numerous details, examples, and embodiments of the invention are described. However, it will be clear and apparent to one skilled in the art that the invention is not limited to the embodiments set forth and that the invention can be adapted for any of several applications.

The device of the present disclosure may be used as a modular workbench system and may comprise the following elements. This list of possible constituent elements is intended to be exemplary only, and it is not intended that this list be used to limit the device of the present application to just these elements. Persons having ordinary skill in the art relevant to the present disclosure may understand there to be equivalent elements that may be substituted within the present disclosure without changing the essential function or operation of the device.

The various elements of the present disclosure may be related in the following exemplary fashion. It is not intended to limit the scope or nature of the relationships between the various elements and the following examples are presented as illustrative examples only.

By way of example, and referring to FIGS. 1-9, some embodiments of the invention include a modular workbench system for quickly and easily interchanging a portion thereof, the modular workbench system comprising a workbench 10 with a cutout therein; and a modular insert panel 30 designed to removably engage with the cutout in the workbench 10, wherein the modular insert panel 30 may or may not include a tool premounted thereon. The system may further comprise an electrical connection component, such as outlet 38, wherein once the modular insert panel 30 is engaged with the workbench 10, an electrical connection may be created, providing power to the tool mounted on the modular insert panel 30 upon the switching on of a switch 36.

Figure 9:
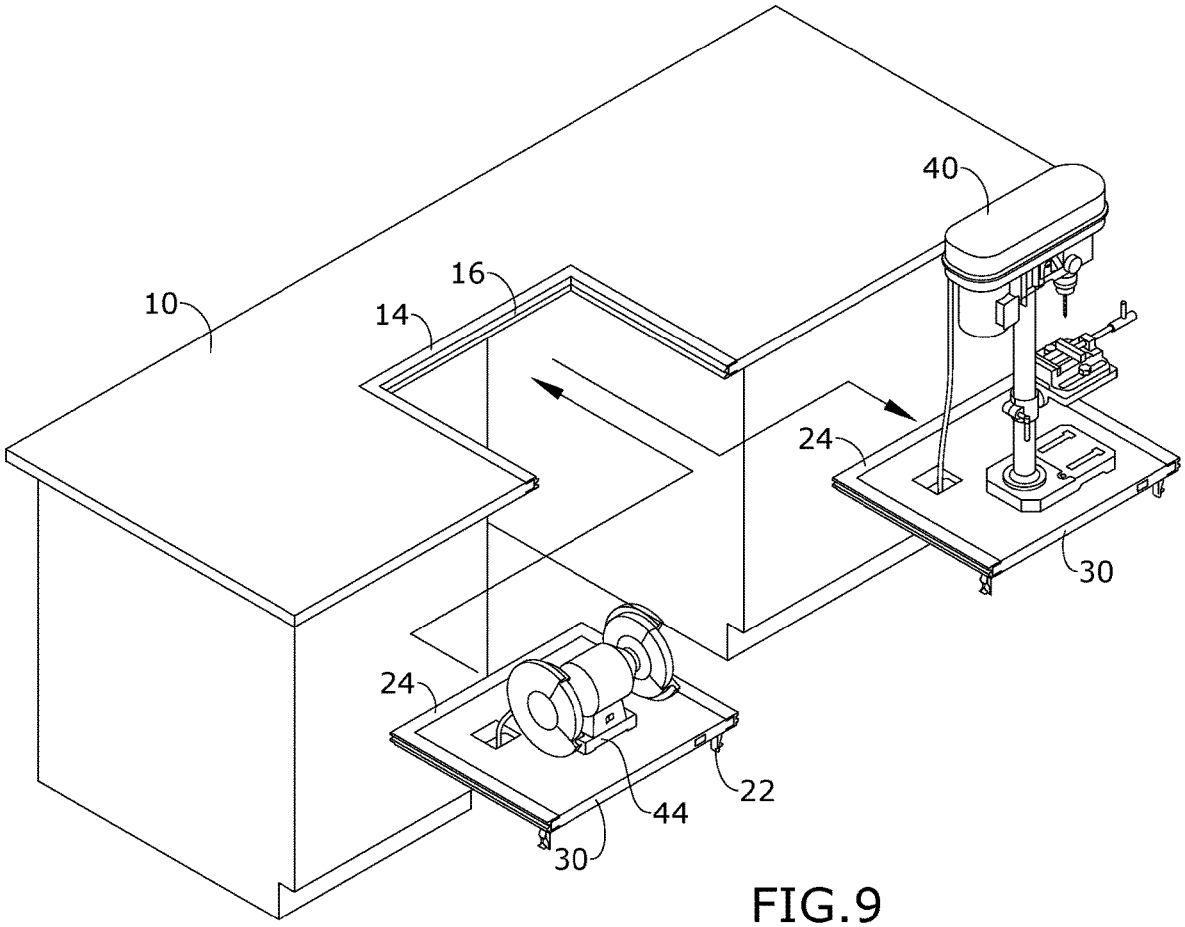
FIG. 9 is a perspective view of one embodiment of the present disclosure, showing interchangeability of insert panels and mounted tools.

As shown in the Figures, the workbench 10 may comprise a cutout, such as a substantially rectangular cutout, wherein edges of the cutout comprise bench grooves. The modular insert panel 30 may comprise insert grooves on all edges of the insert panel 30 other than a front edge, wherein the insert grooves are designed to removably engage with the bench grooves to removably secure the insert panel 30 to the workbench 10. Thus, as shown in FIG. 9, an insert panel 30 may be designed to simple slide into the cutout in the workbench 10 via the engagement of the grooves on the workbench and on the insert panel 30. The insert panel 30 may then be disengaged by sliding the insert panel 30 back out of the cutout and may then be replaced by a second insert panel 30, thus allowing for easy and quick interchangeability of a first mounted tool 40 and a second mounted tool 44 on the workbench 10.

In embodiments, the bench grooves may comprise a bench finger joint and the insert grooves may comprise an insert finger joint, wherein the bench finger joint and the insert finger joint are designed to engage. In a specific embodiment, the workbench 10 may comprise a bench collar 14 attached to the edges of the bench cutout, wherein the bench finger joint is a bench collar finger joint 16 built into an outer surface of the bench collar 14. Similarly, the insert panel 30 may include an insert collar 24 attached to all edges of the insert panel 30 other than a front edge, wherein the insert finger joint is an insert collar finger joint 26 built into an outer surface of the insert collar 24. When an insert panel 30 is inserted into the cutout in the workbench 10, the bench collar finger joint 16 and the insert collar finger joint 26 may engage to create a secure connection, wherein the result is a planar work surface comprising a top surface of the workbench 10, a top surface of the bench collar 14, a top surface of the insert collar 24, and a top surface of the insert panel 30. As mentioned above a tool may be premounted onto the insert panel 30.

As described above, the workbench 10 may include a bench collar 14 attached to edges of the cutout in the workbench 10. The bench collar 10 may be attached to the workbench 10 using any suitable mechanism. For example, the workbench 10 may comprise a bench tongue 12 extending outward from edges of the cutout, and the bench collar 14 may include a bench collar groove 18 sized to accommodate the bench tongue 12, wherein the bench collar 14 is attached to the workbench 10 by inserting the bench tongue 12 into the bench collar groove 18. Similarly, the insert panel 30 may include an insert collar 24 attached to edges of the insert panel 30. The insert collar 24 may be attached to the insert panel 30 using any suitable mechanism. For example, the insert panel 30 may comprise an insert panel tongue 32 extending outward from the edges thereof, and the insert collar 24 may include an insert collar groove 28 sized to accommodate the insert panel tongue 32, wherein the insert panel 30 is attached to the insert collar 34 by inserting the insert panel tongue 32 into the insert collar groove 28.

Figure 1:
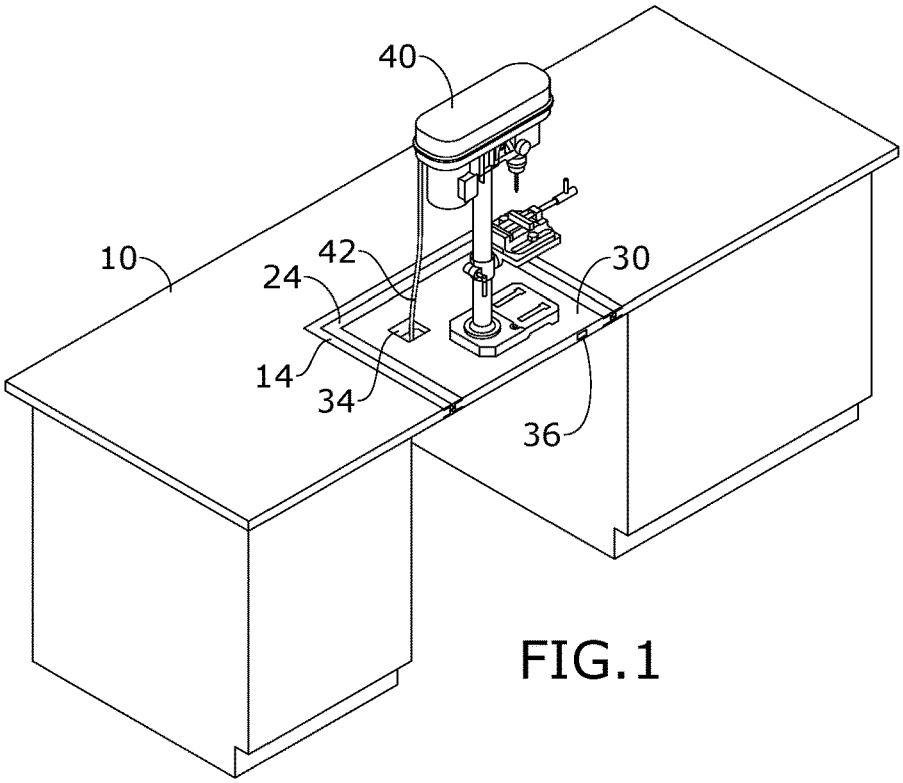
FIG. 1 is a perspective view of one embodiment of the present disclosure, shown in use.
Figure 2:
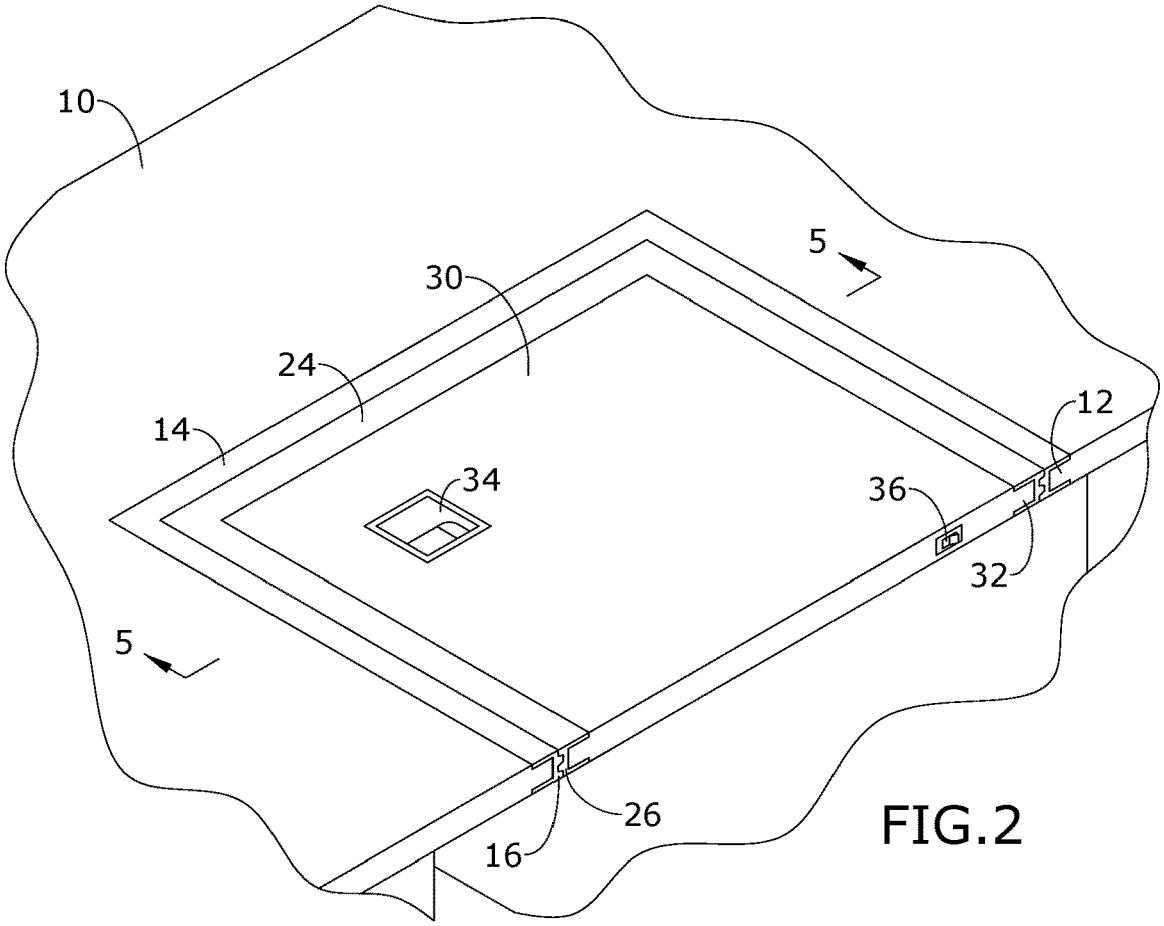
FIG. 2 is a detail top perspective view of one embodiment of the present disclosure.
Figure 3:
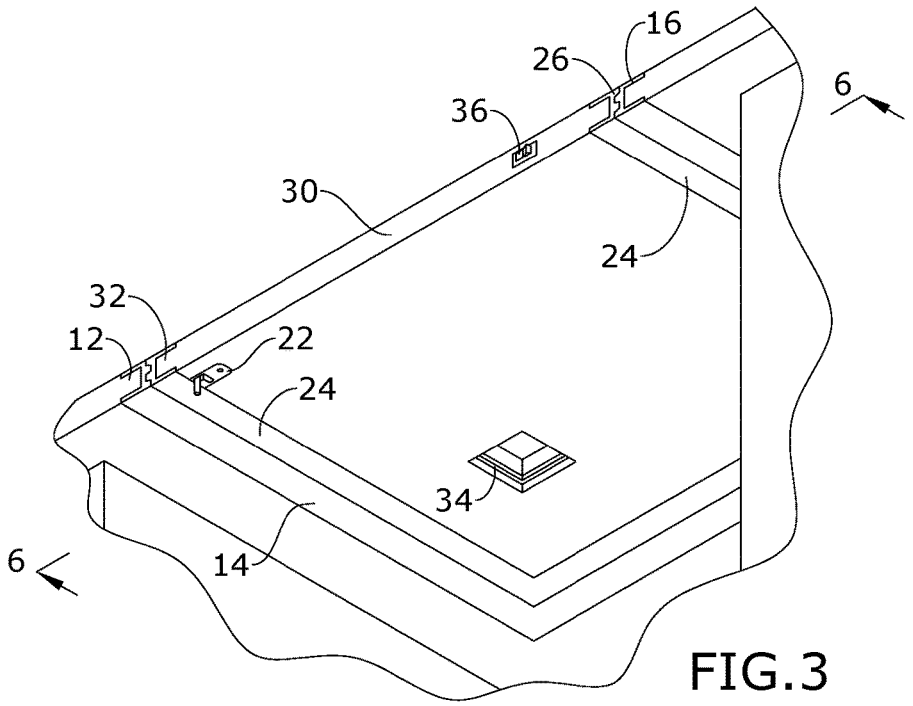
FIG. 3 is a detail bottom perspective view of one embodiment of the present disclosure.
Figure 4:
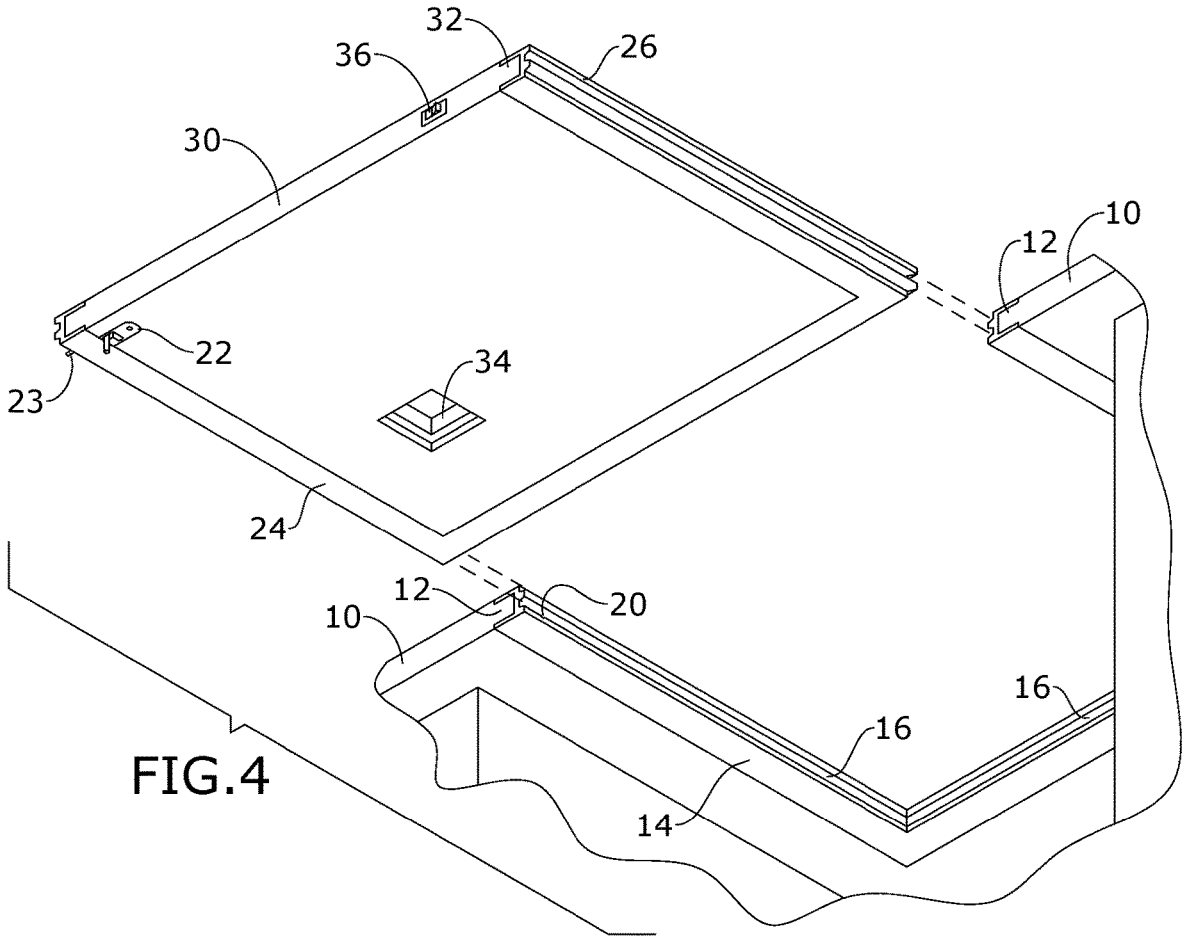
FIG. 4 is a detail bottom exploded view of one embodiment of the present disclosure.
Figure 5:
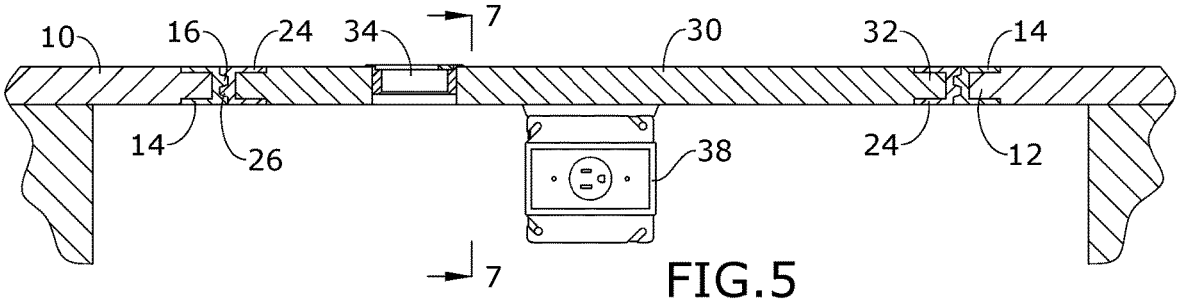
FIG. 5 is a section view of one embodiment of the present disclosure, taken along line 5-5 in FIG. 2.
Figure 6:
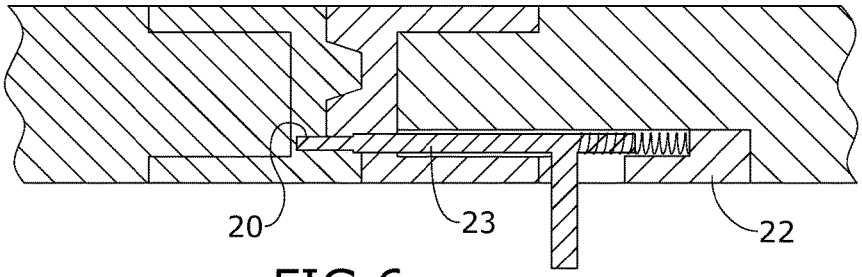
FIG. 6 is a section view of one embodiment of the present disclosure, taken along line 6-6 in FIG. 3.
Figure 7:
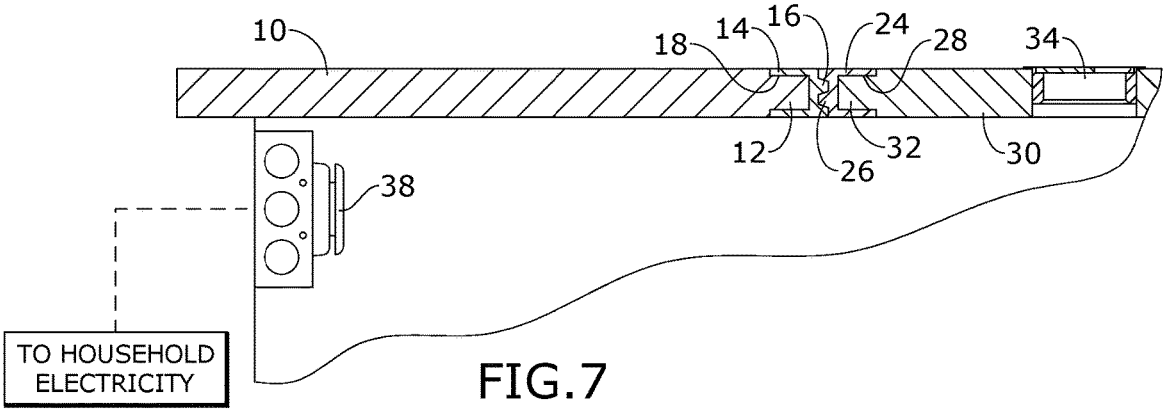
FIG. 7 is a section view of one embodiment of the present disclosure, taken along line 7-7 in FIG. 5.
Figure 8:
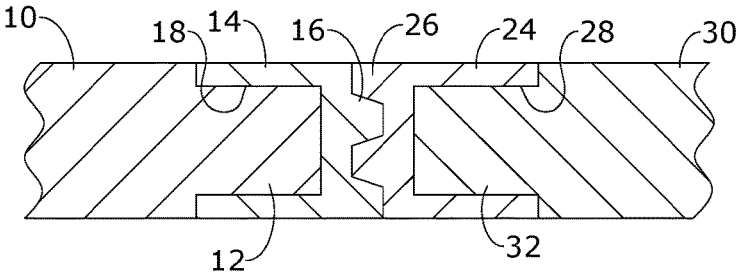
FIG. 8 is a detail section view of one embodiment of the present disclosure.

In some embodiments, the system may further comprise a locking mechanism designed to lock the insert panel 30 to the workbench 10. For example, the locking mechanism may comprise a latch. In some embodiments, and as shown in FIG. 6, the latch may comprise a latch body 22 built into the insert panel 30, wherein the latch body 22 houses a sliding latch bolt 23 therein. For example, the latch bolt 23 may include an elongate rod situated within a channel in the latch body 22. The elongate rod may include a user tab extending perpendicularly therefrom and out of the latch body 22 through an orifice therein. A compression spring may also be positioned within the channel in the latch body 22, such that the spring forces the latch bolt 23 to slide toward and through an edge of the insert panel 30. When a user slides the user tab toward a central portion of the insert panel 30, the latch bolt 23 may slide toward an interior of the insert panel 30, such that an end of the latch bolt 23 no longer extends out of an edge of the insert panel 30. As also shown in FIG. 6, the workbench 10 may comprise a bolt orifice 20 in an edge thereof, such that when the insert panel 30 is inserted into the cutout in the workbench 10, the latch bolt 23 aligns with and is inserted into the bolt orifice 20. While the above description describes the latch body 22 being on the insert panel 30 and the bolt orifice 20 being in the workbench 10, the structure may be reversed such that the latch body 22 is on the workbench 10 and the bolt orifice 20 is in the insert panel 30.

The insert panel 30 may comprise a substantially planar panel. In some embodiments, a cord well 34 may extend through the insert panel 30. The cord well 34 may be sized to accommodate a power cord 42 extending there through. As such, a power tool being used on the insert panel 30 or a power tool premounted on the insert panel 30 may have its power cord 42 extend through the cord well 34 and may be plugged into the outlet 38, which may be operatively attached to an external power source, such as household electricity. In embodiments, where the outlet 38 is operatively connected to the switch 36, the power tool may be powered on by simply flipping the switch 36.

In embodiments, the system may further comprise a storage unit (not shown), wherein the storage unit may comprise a rack or tower with a plurality of grooved brackets, each designed and spaced to engage with an insert panel 30 when not in use.

While the Figures show the insert panel 30 as being substantially rectangular, the shape of the insert panel 30 is not particularly limited. Rather, the insert panel 30 may be any shape corresponding with the cutout in the workbench 10. For example, the insert panel 30 may be squared off with 90° corners, as shown in the Figures. Alternatively, it may be other shapes, such as a trapezoid shape with a wider front edge (i.e., edge facing away from the cutout) with angled corners.

Similarly, while the grooves are shown as being finger joints, the structure of the grooves are not particularly limited so long as they provide for engagement between the insert panel 30 and the workbench 10. Thus, other embodiments of the grooves may include a single dovetail shape sliding into a dovetail shaped groove, multiple dovetail shapes sliding into multiple dovetail shaped groves, square tongue groove, rounded tongue and groove, single tongue and groove, multiple tongue and groove, a single triangle shape sliding into a triangle shaped groove, multiple triangles sliding into multiple grooves, square or rectangle teeth sliding into square or rectangle grooves, multiple tongue and grooves, a round shape sliding into a round channel, and the like. Furthermore, rather than grooves, the insert panel 30 may comprise multiple stationary pins that allow the insert panel 30 to be lowered into place from vertically above the bench 10, wherein the pins slide into precut grooves on the work surface. While examples are described above, any interlocking mechanism is envisioned.

The locking mechanism may comprise any mechanical or electrical method to secure the insert panel 30 into the workbench 10. Exemplary locking mechanisms include sliding pins and/or rods anchored in the workbench 10, such as the latch described above. Other suitable locking mechanisms include a curved or hook shaped lever, such as a compression latch or a cam that engages a pin and locks the insert into place when the lever is actuated. While examples are described above, any locking mechanism is envisioned.

The components of the system may be made of any suitable or desired materials, such as particleboard, solid wood, Corian, carbon fiber, granite, and the like.

To use the system of the present disclosure, an insert panel 30 may be engaged with the workbench 10. The insert panel 30 may be a plain insert and, thus, used to create a flat, unobstructed surface or to provide a flat surface to mount non-electrical tools, like a vice or hand operated bullet press. Alternative embodiments include an insert panel 30 with small magnetized wells sized to accommodate nuts, bolts, screws, washers, and the like. Yet further embodiments comprise electrical insert panels with two form factors, wherein the first form factor comprises an insert with an electrical plug in a cord well. The second form factor may comprise an integrated electrical connection and tool The above-described embodiments of the invention are presented for purposes of illustration and not of limitation. While these embodiments of the invention have been described with reference to numerous specific details, one of ordinary skill in the art will recognize that the invention can be embodied in other specific forms without departing from the spirit of the invention. Thus, one of ordinary skill in the art would understand that the invention is not to be limited by the foregoing illustrative details, but rather is to be defined by the appended claims.

What is claimed is:

1. A modular workbench system for quickly and easily interchanging a portion thereof, the modular workbench system comprising:

a workbench with a cutout therein;

a modular insert panel designed to removably engage with the cutout in the workbench;

a bench collar attached to the edge of the cutout, wherein the bench grooves are built into an outer surface of the bench collar;

an insert collar attached to the edge of the modular insert panel, wherein the insert grooves are built into an outer edge of the insert collar;

a bench tongue extending outward from the edge of the cutout; and a bench collar groove extending into an inner edge of the bench collar, wherein:

an edge of the cutout comprises bench grooves;

the modular insert panel comprises insert grooves on an edge thereof;

the insert grooves are designed to removably engage with the bench grooves; and the bench collar groove is sized to accommodate insertion of the bench tongue therein.

2. A modular workbench system for quickly and easily interchanging a portion thereof, the modular workbench system comprising:

a workbench with a cutout therein;

a modular insert panel designed to removably engage with the cutout in the workbench;

a bench collar attached to the edge of the cutout, wherein the bench grooves are built into an outer surface of the bench collar; and an insert collar attached to the edge of the modular insert panel, wherein the insert grooves are built into an outer edge of the insert collar, an insert panel tongue extending outward from the edge of the insert panel; and an insert collar groove extending into an inner edge of the insert collar, wherein:

an edge of the cutout comprises bench grooves;

the modular insert panel comprises insert grooves on an edge thereof;

the insert grooves are designed to removably engage with the bench grooves; and the insert collar groove is sized to accommodate insertion of the insert panel tongue therein.

3. A modular workbench system for quickly and easily interchanging a portion thereof, the modular workbench system comprising:

a workbench with a cutout therein;

a modular insert panel designed to removably engage with the cutout in the workbench;

an outlet attached to the workbench; and a switch attached to the modular insert panel, wherein:

an edge of the cutout comprises bench grooves;

the modular insert panel comprises insert grooves on an edge thereof;

the insert grooves are designed to removably engage with the bench grooves; and the switch is operatively attached to the outlet when the modular insert panel is inserted into the cutout in the workbench.

4. The modular workbench system of claim 3, further comprising a tool mounted thereon.

5. The modular workbench system of claim 3, further comprising a cord well extending through the modular insert panel.

6. The modular workbench system of claim 3, further comprising:

a latch attached to the modular insert panel, the latch comprising a slidable latch bolt; and a bolt orifice extending into the workbench, the bolt orifice positioned to removably engage with the slidable latch bolt.

7. The modular workbench system of claim 3, further comprising:

a bench collar attached to the edge of the cutout, wherein the bench grooves are built into an outer surface of the bench collar; and an insert collar attached to the edge of the modular insert panel, wherein the insert grooves are built into an outer edge of the insert collar.

8. The modular workbench system of claim 7, wherein:

the bench grooves comprise a bench collar finger joint; and the insert grooves comprise an insert collar finger joint.

9. The modular workbench system of claim 7, further comprising:

a bench tongue extending outward from the edge of the cutout; and a bench collar groove extending into an inner edge of the bench collar, wherein the bench collar groove is sized to accommodate insertion of the bench tongue therein.

10. The modular workbench system of claim 7, further comprising:

an insert panel tongue extending outward from the edge of the insert panel; and an insert collar groove extending into an inner edge of the insert collar, wherein the insert collar groove is sized to accommodate insertion of the insert panel tongue therein.

* * * * *